United States Patent [19]

Bächler

[11] 4,348,825

[45] Sep. 14, 1982

[54] TRACKING OR GRADING UNIT FOR SKI-TRAILS AND PATHS

[76] Inventor: Anton R. Bächler, Seeburgstrasse 10, 6006 Luzern, Switzerland

[21] Appl. No.: 168,132

[22] Filed: Jul. 14, 1980

[30] Foreign Application Priority Data

Jul. 13, 1979 [AT] Austria ..... 4882/79

[51] Int. Cl.[3] ..... E01H 4/00; E01C 19/41

[52] U.S. Cl. ..... 37/222; 37/224; 172/199; 172/63; 172/80; 404/96

[58] Field of Search ..... 37/10, 13, 43 R, 43 C, 37/43 D, 43 E, 117.5, 42 VL, 42 R; 172/35, 63, 80, 74, 50, 75, 51, 76, 393, 197, 394, 199; 404/96

[56] References Cited

U.S. PATENT DOCUMENTS

| | | | |
|---|---|---|---|
| 1,556,448 | 10/1925 | Lloyd | 37/43 R |
| 1,929,799 | 10/1933 | Weeks | 37/42 VL |
| 2,197,549 | 4/1940 | Hargrave et al. | 172/177 X |
| 2,211,277 | 8/1940 | La Mere | 37/43 R |
| 2,994,896 | 8/1961 | Lopes | 37/42 VL X |
| 3,011,564 | 12/1961 | Dahlgren | 172/80 X |
| 3,012,615 | 12/1961 | Pawela | 37/43 R |
| 3,091,873 | 6/1963 | West | 37/43 E |
| 3,503,450 | 3/1970 | Day | 37/43 R |
| 4,057,916 | 11/1977 | Roemer | 172/393 X |
| 4,240,508 | 12/1980 | Ishiguro et al. | 172/80 |

FOREIGN PATENT DOCUMENTS

| | | | |
|---|---|---|---|
| 741307 | 5/1943 | Fed. Rep. of Germany | 37/190 |
| 1120490 | 12/1961 | Fed. Rep. of Germany | 37/42 VL |

*Primary Examiner*—E. H. Eickholt
*Attorney, Agent, or Firm*—Yount & Tarolli

[57] ABSTRACT

A tracking or grading unit for ski-trails and paths, comprises a sliding arrangement having at least one sliding or rolling front and rear support and a frame upon which the supports are mounted. The unit includes a cutting device which is adjustable in height, the cutting device having at least one pivot-arm mounted upon the frame of the sliding arrangement and at least one cutting tool arranged at the lower end thereof.

1 Claim, 5 Drawing Figures

TRACKING OR GRADING UNIT FOR SKI-TRAILS AND PATHS

BACKGROUND AND SUMMARY OF THE INVENTION

The invention relates to a tracking or grading unit for ski-trails and paths, the unit comprising a slide arrangement having at least one sliding or rolling front support and at least one sliding or rolling rear support or runner, and a frame upon which the front and rear supports are mounted, and having at least one cutting means, which is adjustable in height, arranged upon the frame and adapted to cut and/or break-up the snow cover.

A device of this type, having front runners and rear runners in the form of track runners, is disclosed in German OS No. 25 33 831.

The cutting device in this case consists of a digging blade, or the like, rigidly secured to the runner arrangement, the cutting speed and loosening effect thereof being dependent upon and limited by the speed at which the unit travels. Especially if the snow-cover is highly compacted and rutted, the performance of known units is in need of improvement. This is especially so if the constricted and awkward nature of the ground requires the unit to proceed at a relatively low speed. In addition to this, a device of the type mentioned requires a comparatively powerful drive for cutting highly compacted snow, especially if two trails are to be made or conditioned in one operation with double units having a large operating width.

It is therefore the purpose of the invention to provide a tracking or grading unit which permits intensive cutting, and possibly breaking-up, of the snow-cover, largely independent of the rate of travel and of the power of the tractor. According to the invention, this purpose is achieved, in the case of a unit of the type hereinbefore referred to by providing a cutting device with at least one motor-driven cutting tool, the cutting device comprising at least one pivot-arm mounted on the frame of the slide of runner arrangement, and at least one rotary cutting tool arranged at the lower end thereof.

Although a design of this kind is generally used mainly for producing trails and repairing them, the unit may also be used in principle for grading paths, e.g. for a departure run, since the motor-driven cutting tool makes it possible to operate over a relatively large width without impairing the intensity of the work done on the snow-cover.

In any case, what is important is the ability to level short elevations and depressions in the snow-cover, due to the direct mounting of the frame with the front and rear supports arranged relatively close together. This short support-length for the cutting tool allows an almost tangential adjustment and cutting path for longer undulations which cannot be smoothed out with the more intensive removal of shorter undulations.

It is desirable, according to the invention, especially when heavy pressure forces are involved, to provide an adjustable extension limit, in order to avoid deep penetration of the cutting tool and the production of uneven stretches in locations where the snow-cover is soft. It is also of advantage, in maintaining a particularly level trail-surface or path-surface, if a preload is provided for the cutting tool, with a limit-stop acting in the direction of extension of the tool. The result of this is that the pressure resulting from removal of relatively steep elevations, when the cutting tool lifts off the limit-stop, increases sharply in relation to the lift, thus producing particularly intensive action upon the snow-cover at the summit of an elevation.

It has been found particularly advantageous to adjust the height of the cutting tool with a handle in the form of a pivotable lever, comprising a series of locking positions corresponding to the height adjustments. This makes it possible to use a fixed operating position of the cutting tool, such as exists even during relatively high pre-loading in extension towards a stop, as long as the upwardly directed reaction-force, acting upon the tool, does not exceed the preload force plus the weight of the tool and of its mobile holder. The height adjustment may therefore also be used in principle even with a toolholder which is movable in operation.

BRIEF DESCRIPTION OF THE DRAWINGS

Exemplary embodiments of the invention will now be described with reference to the accompanying drawings, in which.

DESCRIPTION OF PREFERRED EMBODIMENTS

Figure 1:
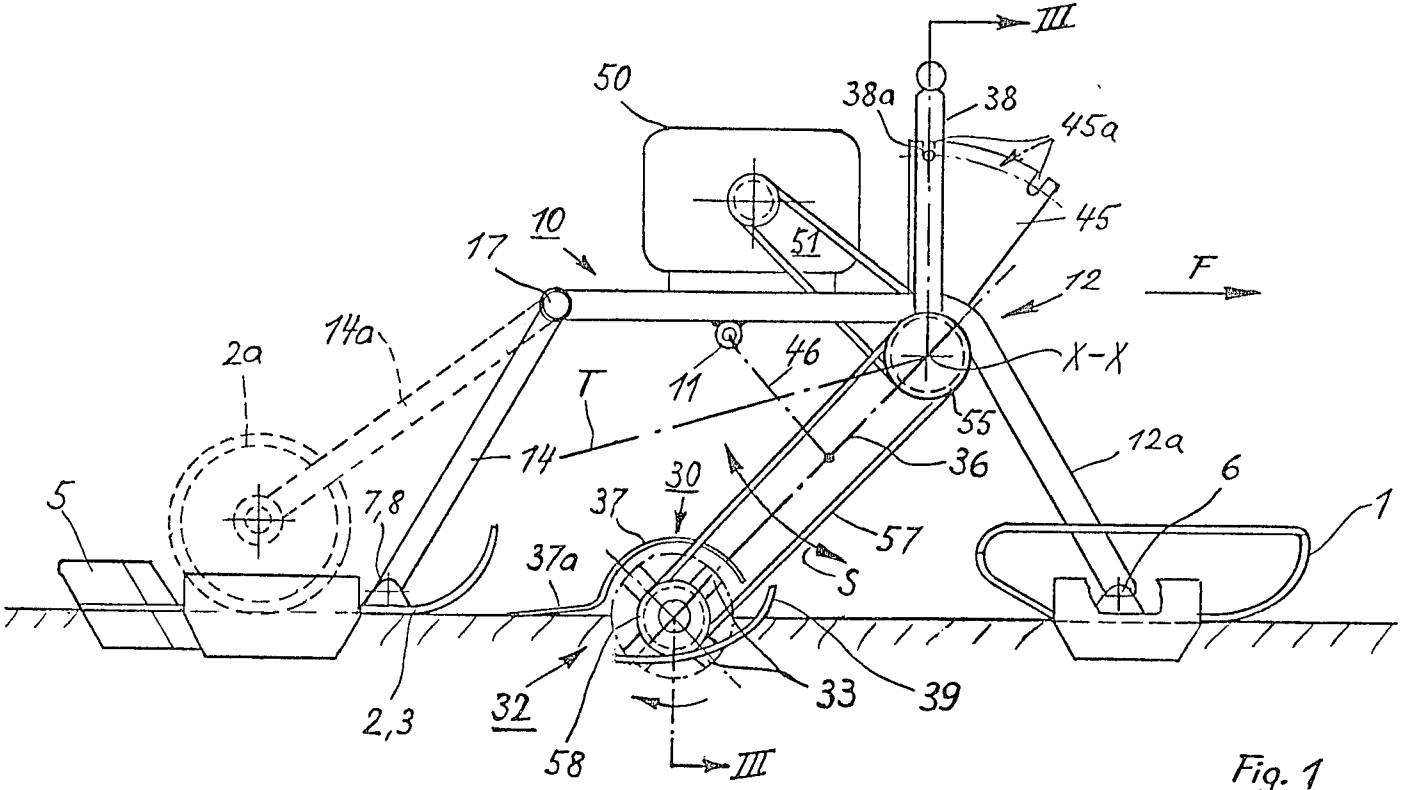
FIG. 1 is a side elevation of a trail-track unit according to the invention.
Figure 2:
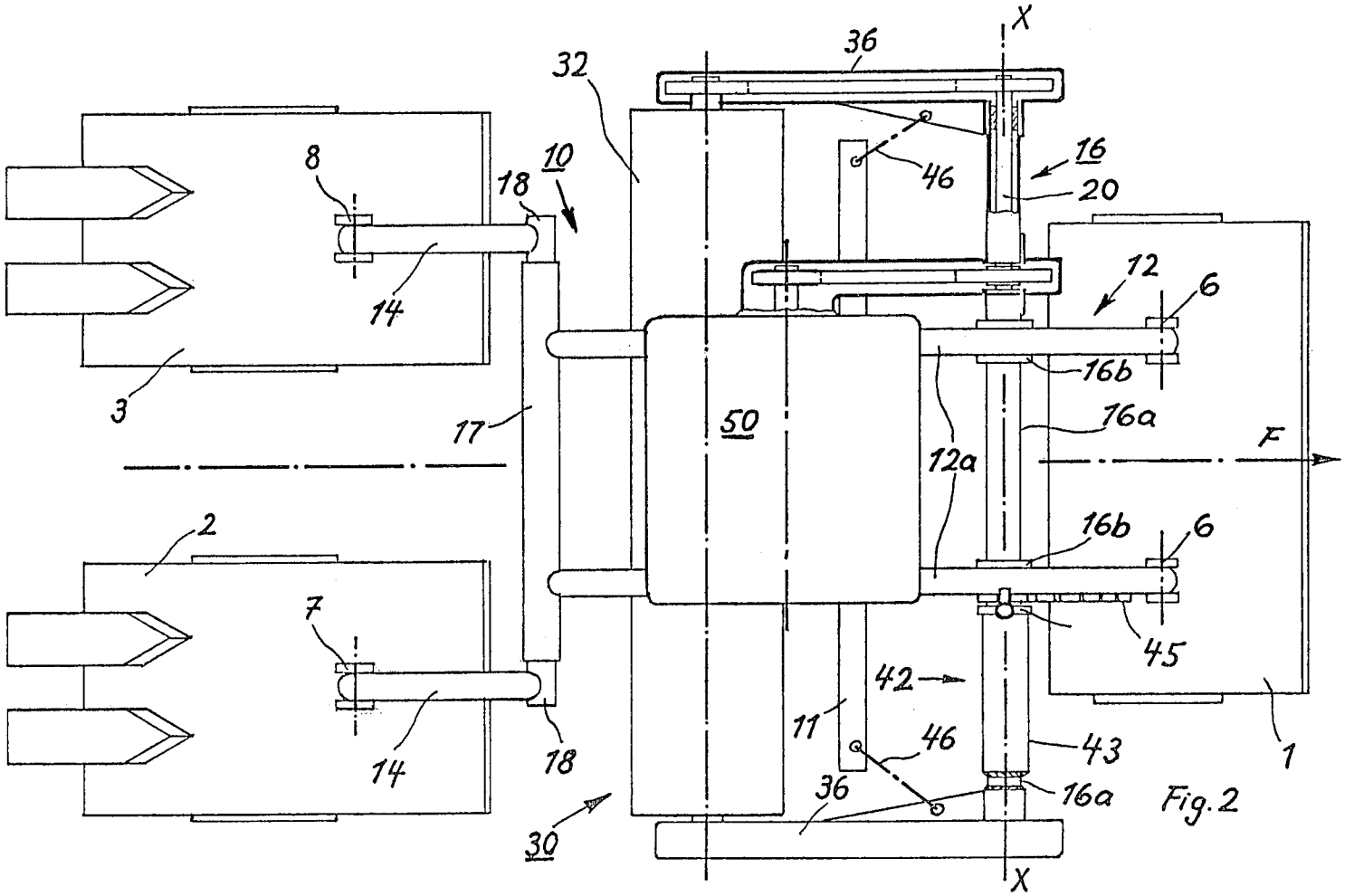
FIG. 2 is a plan view of the unit shown in FIG. 1.

As indicated in FIGS. 1 and 2, the unit comprises a slide arrangement having a front runner 1, and two rear runners 2, 3, arranged at a distance from each other and at right angles to the direction of travel F. This arrangement is for double-track operation with a pair of track elements 5 on each of the rear runners. The front and rear runners are joined together by a bridge-like frame 10, each having pivot-mountings 6, 7 and 8. Frame 10 consists of a main part 12 with a pair of supports 12*a* extending in the direction of travel and united by a front horizontal transverse member 16 and a corresponding rear transverse member 17. The former covers the entire width of the unit and carries an internal drive-shaft 20 for a cutting device 30 arranged below the central part of the frame, while the latter comprises torsion-members 18 at each end, which can be moved towards or away from each other in order to vary the double-track spacing, with supporting arms 14 for runners 2, 3.

The cutting device 30 consists of a cutting tool 32, in the form of a roller, with cutting elements 33 around its periphery, which grips under the central part of the frame 10 and extends over the entire width of the unit. The elements 33 may be, for example, in the form of blades set at an angle to the axis of the roller, or they may be curved or bent for particularly intensive breaking-up of the snow cover. The ends of the cutting tool 32 are mounted on pivot arms 36. The centre line of the one of these arms being shown diagrammatically in phantom in FIG. 1.

Figure 3:
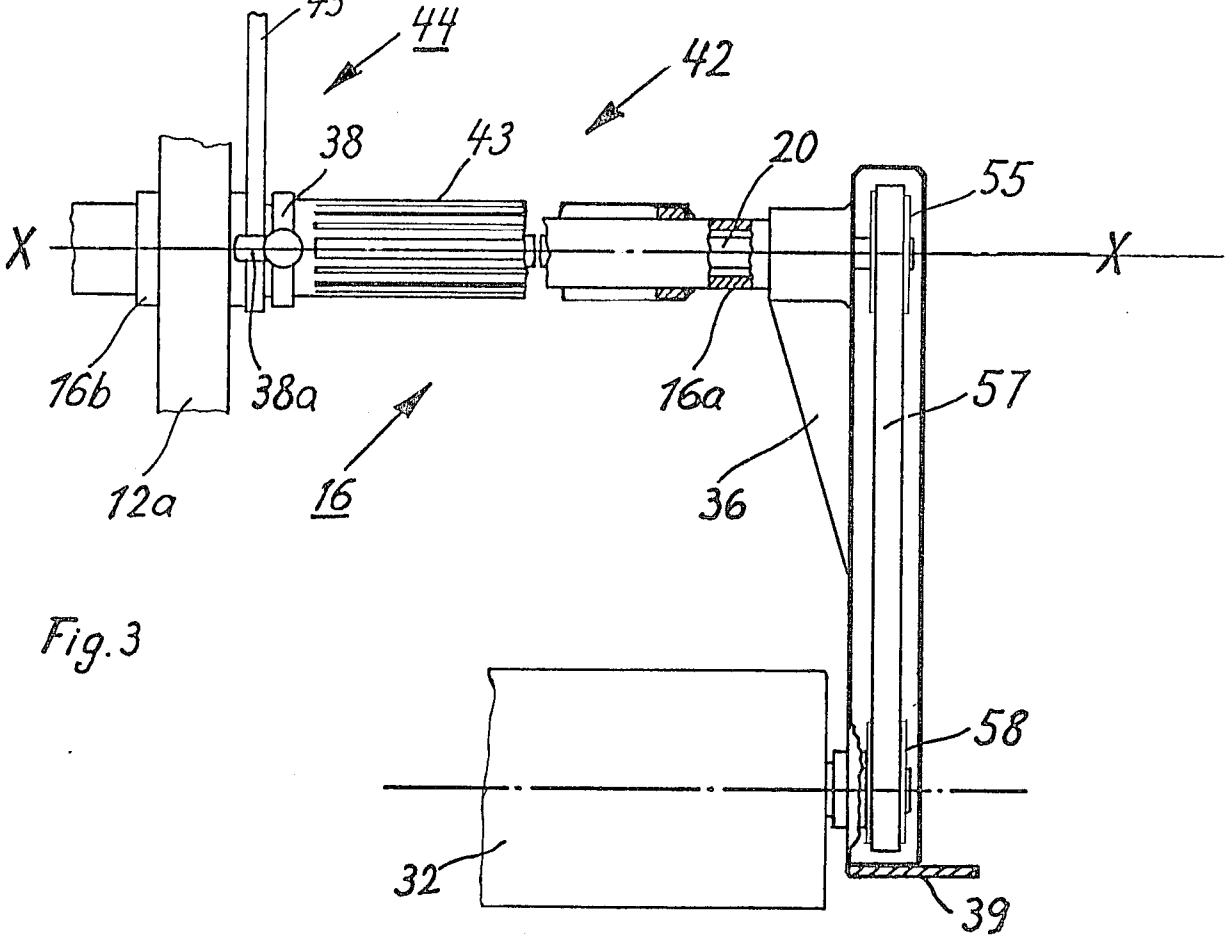
FIG. 3 is a partial section through the cutting-device holder along the line III—III in FIG. 1.

Pivot-arms 36, in turn, are mounted to rotate about a horizontal axis X—X of the transverse member 16, and the design thereof is illustrated diagrammatically in FIG. 3. As shown in the latter, each pivot-arm 36 is non-rotatably secured to a tubular element 16*a* in the transverse member 16, in conjunction with which it carries out a resilient pivoting motion, about axis X—X, in the direction of arrow S in FIG. 1, under the load produced by the operating pressure of the cutting device. To this end the tubular element 16*a* is mounted so as to rotate in bearings 16*b* on supports 12*a* on frame 10, and is supported resiliently by means of a torsion-spring 42. In this case, the torsion-spring has a torsion-element 43 in the form of a sleeve with multiple longitudinal slots (FIG. 3), the outer end of the sleeve being secured against rotation to the transverse element 16*a*, for example by welding. The inner end of the torsion-spring element 43 is connected to the frame 10 by a pivoted adjusting device 44 and remains fixed, in relation to the frame, in the adjusted position. The adjusting device 44 consists of a locking disc 45 having a plurality of recesses 45*a* around its periphery for the accommodation of a spring-pin 38*a* located in a pivot-lever 38. This lever, which serves as a means for setting the neutral position of the torsion spring, is secured by its lower end to the torsion-spring element 43, thus making it possible to set the inner end of this spring-element to any desired position of rotation in relation to the frame 10. The pivot-arms 36, fitted to the outer ends of the transverse element 16*a* by the end-sections thereof, can oscillate about this neutral position, to which they are resiliently biased. When the arms pivot upwardly in the direction of arrow S, there is an increase in the pressure applied to the snow-cover. On the other hand, when the arms pivot downwardly, the load on the tool is relieved by its own weight. Thus the optimal pressure for the given conditions may be adjusted conveniently and varied as regards extensions and retraction.

If it is desired to set the cutting tool to a fixed but adjustable height, all that is required is an appropriately stiff torsion spring, i.e. a thicker and shorter shaft.

The extension movement, and thus the depth of penetration of the tool is controlled, as shown in FIG. 1, by means of a restriction, for example a tension-element 46, in the form of a length of chain or cable, secured between pivot arms 36, designed in the form of a casing, and a transverse member 11 on the frame 10. The degree of pivoting of the end of the torsion-spring element 43 adjacent the frame can now be selected in such a manner that the cutting device 30, in its position of maximal extension, according to the tension-element 46, is preloaded. Thus, when the tool is retracted, progressive, increasing presssure is applied to the snow-cover.

Figure 4:
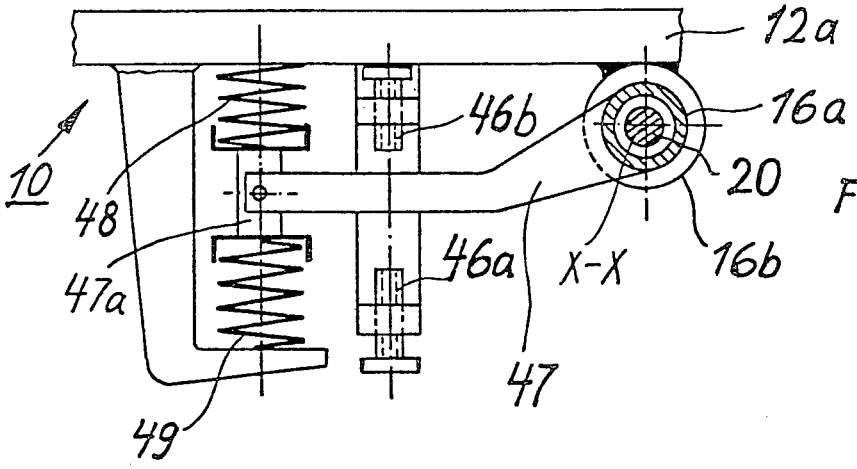
FIG. 4 shows a detail of the resilient, cutting-device holder in a modified design.

In this connection, FIG. 4 illustrates a modified torsion-spring and pivoting adjustment for a tubular horizontal transverse member 16, which is mounted upon the frame 10 to rotate about axis X—X, the pivot-arm 47 being secured to the transverse member against rotation in relation thereto. Preload springs 48, 49, acting in the extension and retraction-direction engage with the arm, the neutral position being adjustable by shifting the arm in relation to a coupling part 47*a* between springs 48, 49. The extension and retraction motions of the cutting tool are adjustably restricted by means of stop-screws 46*a*, 46*b*, secured to the frame 10. As in FIG. 1, the cutting tool is connected to the rotatable horizontal transverse member 16 by pivot arms. Fixed height adjustment can also be provided with this device by bringing the stop-screws 46*a*, 46*b* together.

The cutting tool is driven by a motor unit 50 arranged upon the central part of the frame, through a chain-drive 51 to shaft 20 within the horizontal transverse member 16, hence by drive-wheels at each end of this shaft and through drive-elements 5, for example V-belts or chains, to drive-wheels 58 secured to the shaft of the roller-like cutting tool. The secondary drive, consisting of drive-wheels 55, 58 and drive-element 57, is accommodated on both sides of the unit in the pivot-arms 36 designed in the form of housings, to the lower ends of which are fitted runners 39 which provide direct support for the cutting tool upon the snow-cover. Thus they prevent the tool from penetrating too deeply. A guard 37 extends over the upper part of the periphery of the cutting tool. This prevents the broken-up snow from being thrown upwardly and eliminates the danger of coming into contact with the tool when the tool is lifted—for example into the inoperative or transportation position T shown in FIG. 1. This lifting movement may be accomplished with the aid of the pivot-lever 38 and locking disc 45. The guard 37 extends rearwardly in the form of a spreader-plate 37*a* which smooths down, or slightly compacts, the cut snow. To this end, it is desirable for the plate to be designed to yield resiliently.

Figure 5:
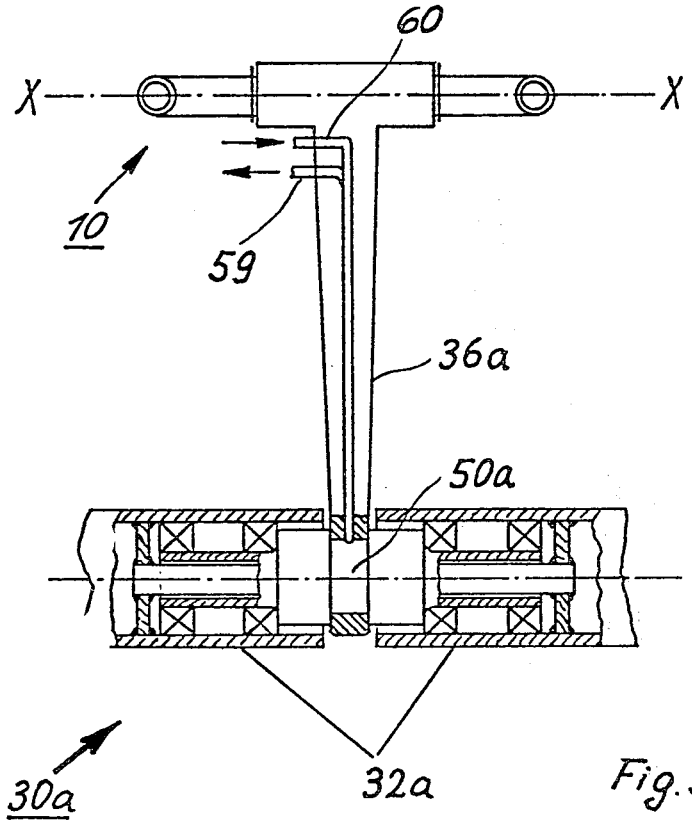
FIG. 5 shows another design of cutting device having a single central pivot-arm and a cutting tool projecting in both directions, in a vertical section at right angles to the lengthwise or travel direction of the machine.

In the design according to FIG. 5, the cutting device 30*a* is provided with a single pivot-arm 36*a* arranged centrally of the width of the unit, and with a two-part cutting tool 32*a*, mounted at the lower end of the pivot-arm and projecting freely in both directions. Here again the two parts of the cutting tool are in the form of rollers and are equipped with appropriate peripheral cutting elements. The tool may be driven as shown in FIGS. 1 and 2 now through a single pivot-arm, by means of a chain-drive or the like, from a motor arranged upon the frame of the unit. To this end, the two halves of the tool are mounted in the vicinity of the lower end of the pivot-arm so that they cannot rotate relatively to one another.

FIG. 5 illustrates another type of drive, using a drive unit 50*a* arranged coaxially with the roller-like tool and coupled directly thereto. A hydraulic or pneumatic motor may be appropriately used for this purpose. A hydraulic motor will require flexible couplings (not shown) to be connected to lines 59, 60 running to the motor. In the case of a pneumatic motor, only one line will be needed since the air, after it has done its work, may be allowed to escape freely. A suitable pump-motor unit, of conventional design may be attached to the frame of the unit as in FIG. 1, or may be arranged upon a tractive unit, for example a caterpillar tractor, and may be connected through flexible lines to the pressure system of the unit.

The rotating, roller-like cutting tools, each fitted to a single pivot-arm, may also be arranged to project in one direction only. This makes it possible for each side of the unit to have its own cutting tool which is independently adjustable in height.

Generally speaking, this arrangement of roller-like cutting tools projecting from one or both sides of a pivot-arm has the advantage that there are no drive or transmission elements projecting beyond the outer ends of the tools and penetrating into the undisturbed snow cover. Instead, the cutting elements may extend right to the outer ends of the cutting elements. It is even possible to use special tools on the end faces for the purpose of processing the edges of the paths or trails.

Finally, it should also be mentioned that the design according to the invention is not restricted to sliding front or rear supports. The rear support in particular, or even a plurality of rear supports arranged side by side, may also be fitted with rolling support-elements. This possibility is shown by dotted outline in FIG. 1, as applied to the rear supports which are in the form of rollers 2*a* mounted upon suitably designed support arms 14*a*.

I claim:

1. An apparatus for grading ski trails or paths comprising at least one front support and at least one rear support, a frame for mounting said front and rear supports, said frame including a transverse pivotable tubular member, a pivot arm fixedly connected at one end thereof to said tubular member for joint rotation therewith, a cutting device for cutting the snow cover, said cutting device being attached to the other end of said pivot arm, rotary spring means for biasing said cutting device toward the snow cover, said rotary spring means including a torsion spring sleeve, one end portion of said torsion spring sleeve being fixedly connected with said tubular member, and adjusting means for adjustably connecting the opposite end portion of said spring sleeve with said frame to thereby adjust the force applied to said cutting device, said adjusting means including a locking disc attached to said frame and having a plurality of recesses around the outer periphery thereof, and a pivot lever fixedly secured to said other end of said torsion spring sleeve, said pivot lever including a pin which is adapted to engage any of said plurality of recesses in said disc to adjust the force applied to said cutting device.

* * * * *